US007806816B2

(12) United States Patent
Erez

(10) Patent No.: US 7,806,816 B2
(45) Date of Patent: Oct. 5, 2010

(54) ASSEMBLY FOR STABILIZING SEATED INDIVIDUALS WHILE EXERCISING OR PERFORMING SPORTING OR OTHER PHYSICAL ACTIVITIES

(76) Inventor: Miki Erez, 15500 Palmetto Lake Dr., Miami, FL (US) 33157

( * ) Notice: Subject to any disclaimer, the term of this patent is extended or adjusted under 35 U.S.C. 154(b) by 15 days.

(21) Appl. No.: 12/074,492

(22) Filed: Mar. 4, 2008

(65) Prior Publication Data

US 2008/0224460 A1 Sep. 18, 2008

Related U.S. Application Data

(63) Continuation-in-part of application No. 11/102,147, filed on Apr. 8, 2005, now Pat. No. 7,338,418.

(51) Int. Cl.
*A63B 23/00* (2006.01)

(52) U.S. Cl. ..... 482/148; 482/69; 119/770

(58) Field of Classification Search ..... 482/69, 482/78, 123, 148; D29/101; 244/151 R; 119/770

See application file for complete search history.

(56) References Cited

U.S. PATENT DOCUMENTS

| | | | | |
|---|---|---|---|---|
| 3,321,247 | A * | 5/1967 | Dillender | 297/465 |
| 3,380,776 | A * | 4/1968 | Dillender | 297/484 |
| 3,954,280 | A * | 5/1976 | Roberts et al. | 280/801.2 |
| 4,153,244 | A | 5/1979 | Tauber, Jr. | |
| 5,100,128 | A | 3/1992 | Mabry et al. | |
| 5,180,030 | A | 1/1993 | Smaby | |
| 5,277,685 | A | 1/1994 | Gonzales | |
| 5,709,631 | A | 1/1998 | Kleinsasser | |
| 5,762,593 | A | 6/1998 | Whiteley | |
| 5,839,995 | A | 11/1998 | Chen | |
| 5,988,098 | A | 11/1999 | Hillhouse | |
| 6,036,623 | A | 3/2000 | Mitchell | |
| 6,122,778 | A * | 9/2000 | Cohen | 5/81.1 R |
| 6,431,424 | B1 * | 8/2002 | Smith | 224/583 |
| 7,338,418 | B2 | 3/2008 | Erez | |
| 2004/0169411 | A1 * | 9/2004 | Murray | 297/486 |
| 2006/0113147 | A1 * | 6/2006 | Harris, Jr. | 182/3 |

* cited by examiner

*Primary Examiner*—Lori Baker
(74) *Attorney, Agent, or Firm*—Malloy & Malloy, P.A.

(57) ABSTRACT

An assembly for stabilizing an individual while exercising or performing various sports or physical activities in a seated position, such as a wheelchair or other support structure. A harness assembly comprises one or more harness structures each removably secured to a predetermined part of the individual's body in a manner which safely stabilizes the individual while the individual is exercising or performing sporting or other physical activities. A restraint assembly comprises a plurality of restraining members interconnected to each of the plurality of the harness structures being used, and to an anchor assembly disposed in underlying supporting relation to the individual and the support structure. The restraint assembly is cooperatively structured with the anchor assembly to maintain any of the harness structures being utilized and the corresponding body portion of the individual in a stable, operative position best suited to effectively and safely perform the intended exercise.

9 Claims, 11 Drawing Sheets

ASSEMBLY FOR STABILIZING SEATED INDIVIDUALS WHILE EXERCISING OR PERFORMING SPORTING OR OTHER PHYSICAL ACTIVITIES

CLAIM OF PRIORITY

The present application is a continuation-in-part application of previously filed, now pending application having Ser. No. 11/102,147, filed on Apr. 8, 2005, which will mature into U.S. Pat. No. 7,338,418 on Mar. 4, 2008, and which is incorporated herein by reference.

BACKGROUND OF THE INVENTION

1. Field of the Invention

This invention is directed to an assembly to stabilize individuals while seated in a wheelchair or other support structure, such that a user's body is safely maintained in an operative position necessary to correctly and safely perform a variety of exercises, sporting or other physical activities.

2. Description of the Related Art

In today's fast paced society, exercise has become an increasingly important part of many individuals' lives. It is well established that a regular exercise program in addition to a proper diet serve to increase the ones overall health and facilitate the ability to follow an active, full rounded lifestyle. In an effort to take advantage of a significant part of the population being involved in regular exercise programs, industries involved with exercise apparatus and devices have made available a plurality of different exercise machines, apparatus, procedures, programs etc. to aid the average individual in accomplishing a full range of exercise in order to benefit the entire body.

Clearly, the vast majority of known, commercially available exercise machines and like assemblies are designed, structured and configured for the average, active individual who has full use of his or her body. However, fairly recently it has been recognized that physically restricted individuals, including the elderly as well as invalids and/or the physically challenged, also significantly benefit from a regular exercise program. Exercise programs for such restricted individuals have been modified to suit specialized needs due in part to the fact that both the active and relatively inactive portions of an individual's body benefit from regular exercise. Similarly, individuals who have reached an advanced age may have lost partial or efficient use of certain parts of the body such as the joints associated with the legs, hips, arms, etc. It has also been determined that elderly individuals of the type described also significantly benefit from a continued and appropriate exercise program which serves to increase the range of motion of the various parts of the individual's body as well as improving ones overall fitness profile.

However, for invalids, the elderly and other select groups of individuals, it is necessary or more comfortable to perform at least some of the individual exercises of a predetermined exercise program while being seated. In the case of certain traumatically injured or otherwise restricted individuals, it may be necessary to perform the intended exercise program from a wheelchair or other support structure. As such, the individual is capable of a certain degree of mobility and independence while being able to maintain a comfortable, seated and safe orientation.

In order to facilitate the performance of exercise by individuals while in a seated position, wheelchairs and like support structures, as well as the exercise assemblies and/or apparatus have been customized by including certain structural modifications not typically found in corresponding exercise apparatus used by individuals having a full and unfettered range of motion of their body parts. By way of example, modified exercise bicycles or a similar category of structures, are known and commercially available wherein both active and inactive parts of a user's body may be exercised. Similarly, treadmill like structures are available which have been structurally modified to adapt the use thereof to individuals having a restricted field of motion of at least certain body parts. Similarly, some treadmill-like roller arrangements are specifically designed and structured to be used in combination with wheelchairs and include a specialized wheelchair support disposed above or in a predetermined orientation relative to the supporting frame of the treadmill. In addition, certain wheelchairs have been modified from a substantially conventional structural configuration which enables their use with various types of customized or conventional exercise apparatus.

Accordingly, while structural and operational modifications, of the type generally set forth above, are assumed to be at least partially suited for their intended function, the majority of such structural modifications must be adaptive with other known or specialized exercise assemblies in order for an exercise program to be performed. Clearly, customization of the type referred to is expensive, not widely available in the market place and oftentimes involves a restriction of the normal function or performance of wheelchairs or like support structures as originally intended.

Therefore, there is a significant and long established need in this area for an assembly which facilitates the stabilization of an individual while performing exercise in a seated position. Further, such an assembly, if developed, should overcome the problems and deficiencies of equipment presently available, such as generally set forth above. Most preferably, a stabilization assembly of the type referred to should allow a physically restricted individual to perform a variety of different exercises as well as other selected sporting and physical activities. Concurrently, the proposed stabilizing assembly should be structured to assure that the user's body is properly oriented and that the individual will be safely and securely maintained on the wheelchair or other support assembly during the performance of the exercise or sporting activity.

While the proposed stabilization assembly of the present invention is specifically associated with the performing of body building exercise, it is emphasized that is also structured to facilitate performance of various types of sports activities as well as other physical activities, which may not be typically classified as exercise of the type practiced on exercise equipment. More specifically, the proposed stabilizing assembly of the present invention is intended for use by individuals while practicing other primarily upper body activities such as, but not limited to, golfing, fishing, javelin throwing, archery, rowing, riflery or shooting, shot put throwing and various movements involving the use of a punching bag. Accordingly, a variety of different sporting or related physical activities may be better practiced while the individual is in a seated position on a wheelchair or other support structure utilizing one or a plurality of different embodiments of the proposed stabilizing assembly.

Accordingly, when a physically restricted individual is desirous of performing an exercise routine or a variety of different sporting activities, substantially conventional and commercially available exercise assemblies and/or sporting equipment may be used. As a result, disadvantages including cost, availability and safety associated with the use of exercising and sporting equipment which are customized for physically restricted individuals may be avoided. Also, the various structural and operative components of a preferred stabilizing assembly should be easy to use, install and assemble, thereby allowing the restricted individual to perform intended and appropriate exercise programs in a manner which does not significantly depend on others. In addition, a preferred assembly of the type used to stabilize seated individuals while exercising, etc. should be comfortable and comprise a structural integrity which would render the assembly continuously useable over an extended operable life.

Finally, a proposed and preferred stabilizing assembly should also provide a significant degree of safety to a physically restricted individual, wherein such safety assures the individual that he or she will not be inadvertently dislodged from the wheelchair or support structure. In addition to possible injury resulting from the individual falling from the support structure, the individual should be secure in the belief that he or she will be able to maintain proper position and orientation and not be subject to embarrassment or require reliance on others during the performance of the exercise or sporting activity. It is also known that some individuals having spinal cord injuries suffer from an occasional attack of spasms. The severity of such spasms may be such as to facilitate the individual falling from the wheelchair or other support structure. Accordingly, an adequate "safety factor" incorporated in the proposed stabilizing assembly allow the physically challenged individual to have a significant degree of self-confidence, independence and self-reliance thereby further enhancing the self-esteem of the individual, not only while performing the selected exercise or sporting activity but in other aspects of the individual's life.

SUMMARY OF THE INVENTION

The present invention is directed to an assembly which serves to stabilize a seated individual and more specifically, at least predetermined portions of the individual's body while the individual is exercising or performing a variety of different sporting or other physical activities. As such, the stabilizing assembly is intended for use by those individuals who may be physically restricted at least to the extent of having one or more portions of their body being entirely or partially incapable of use or movement through a normal range of motion. Such a category of individuals may include those who have lost at least partial use of a portion of their body because of trauma, disease, age, etc. Further, the structural and operational versatility of the assembly of the present invention is such as to properly and safely stabilize a user's body in order to effectively perform a plurality of exercises or sporting activities. Moreover, the stabilizing assembly of the present invention allows a physically challenged individual to perform a variety of exercises which will be set forth in detail hereinafter. However in addition, the individual will be allowed to safely perform a variety of sporting activities which primarily involve the use of the upper torso of the individual, while the individual is seated on a wheelchair or other support structure. By way of example only, such additional sporting or physical activities may include golfing, fishing, javelin, archery, riflery, shot-put throwing, rowing and various activities involved with a punching bag. As a further note, many of these sporting activities are officially recognized by special Olympic organizations dedicated to the competition of physically challenged individuals.

According, the assembly of the present invention comprises a harness assembly including at least one but more practically a plurality of harness structures each of which is dimensioned, configured and structured to be secured to one or more predetermined portions of an individual's body in order that various exercises or sporting activities may be properly and safely performed. The particular harness structure utilized, as well as the body part to which it is attached, is of course dependent, at least in part, on the particular exercise or sporting activity being performed and possibly the type of injury an individual may have suffered. Moreover, the structural and operative features of each of the plurality of harness structures are such as to maintain and/or stabilize the individual's body in a seated position during the performance of the exercise or other physical activity. As a result, a variety of exercise or sporting activities may be independently and properly performed in a manner which provides maximum physical benefit to the individual, while at the same time assuring the individual's peace of mind due to the inherent safety features associated with the harness assembly of the present invention. As explained in greater detail hereinafter, each of the harness structures may be used independently and/or in combination with one another depending, at least in part, on the specific activity being performed.

Stabilization of the individual is also accomplished by a cooperative structuring and disposition of a restraint assembly and an anchor assembly both included as operative parts of the stabilization assembly. More specifically, the restraint assembly is removably and/or adjustably connected to the one or more harness structures mounted on the individual and is removably attached to the anchor assembly. In one embodiment the anchor assembly is disposed in supporting relation beneath the individual and the wheelchair or other support structure in which the individual is seated. As such, the anchor assembly may comprise a support platform or like structure disposed and structured, by virtue of its connection with the restraint assembly, to at least partially restrict or at least regulate movement of the predetermined portion of the user's body to which the harness assembly is attached. Accordingly, the individual is able to securely and safely maintain an intended operative position required to effectively perform a given exercise or activity. As should be apparent, the absence of proper stabilization of the body of the individual would frequently result in the inability to perform the exercise or sports activity or the performance thereof in an improper manner. It is also to be noted that the anchor assembly could be defined by a more conventional floor, ground or other supporting surface modified to facilitate removable connection to the aforementioned restraint assembly, rather than the aforementioned support platform. Further, the cooperative structuring of the restraining assembly and the anchor assembly is such as to "connect" the individual to the anchor assembly rather than the wheelchair, thereby significantly add the aforementioned "safety factor" to the use of the stabilizing assembly of the present invention.

In order to allow an individual to perform a variety of different exercises and/or sporting activities and thereby provide benefit to various portions of his or her body, the plurality of harness structures may vary from one another in both size and configuration, dependent at least in part on the portion(s) of the body to which it is to be attached. By way of example, the plurality of harness structures may include a vest or vest-like structure including one or more harness segments disposed and structured to collectively or individually surround the waist, chest and back of the individual. Also, the vest structure may include at least one but more typically two shoulder straps disposed in overlying relation to the shoulder (s) portion of the wearer and disposed in interconnecting relation between the front and back portions of the vest.

Another of the plurality of harness structures may be specifically intended to overlie and cover a portion of the "lap" of the individual while in the seated position. Also, the plurality of harness structures may include a generally annular member of sufficient dimension and configuration to fit over the individual's head and/or somewhat surround the neck of the individual while being outwardly spaced there from in overlying relation to at least an inner portion of the shoulders or other body area adjacent the neck of the individual. Further, this annular member may be dimensioned and configured to also surround and restrictively engage the waist or hip area of the individual thereby enabling it to stabilize different portions of the individual's body dependent, as set forth above, on the exercise or activity being performed as well as a variety of other factors.

It is emphasized that the various harness structures, as described above, are representative only of a larger number of harness structures which may define the harness assembly. In addition, any other harness structure(s) may be used independently of the above more specifically described harness structures or may be used in combination therewith. Further by way of example, the harness assembly may also comprise an auxiliary harness structure including an elongated, rigid material bar or shaft secured to the shoulder straps or other portions of the vest-like harness structure so as to extend outwardly from a frontal portion of the vest structure. Additional structural and operative features of the auxiliary harness structure, as well as others of the plurality of harness structures, will be described in greater detail hereinafter.

As also set forth above, a primary function of the restraint assembly is to stabilize each of the plurality of harness structures utilized by interconnecting and thereby "anchoring" the harness structure to the anchor assembly. In doing so, the harness structures and the corresponding body portions to which they are attached, will be at least partially restrained from undesirable or unsafe movement which may be caused by a resistance or reaction force being placed on that corresponding body portion during the performance of the various exercises or other physical activities. Therefore, the restraint assembly comprises a plurality of restraining members connected to the one or more harness structures being utilized and removably connected, at spaced apart locations, to the anchor assembly.

A specific location of interconnection between the harness structure utilized and the anchor assembly is again dependent upon the dimension, configuration and structure of the harness structure being utilized and the exercise or sporting activity being performed. Therefore, the anchor assembly preferably comprises the support platform or other supporting surface or structure having a plurality of anchor members disposed in spaced apart relation thereon. Each of the anchor members is cooperatively structured with the plurality of restraining members to facilitate removable connection therebetween. Also, a spaced apart array of anchor members on the anchor assembly allows for the selective positioning of the plurality of restraining members such that an adequate and predetermined restraining or stabilizing force can be exerted on the harness structure in order to stabilize the body part to which it is attached.

As generally set forth above, at least one embodiment of the present invention comprises the anchor assembly being defined by a support platform on which the wheelchair or other support structure supporting the individual is mounted. Therefore, it should be readily apparent that the weight of the wheelchair or other support structure as well as the weight of the individual serves to render the support platform of the anchor assembly in a secured, intended position thereby allowing it to provide sufficient anchoring force to the harness assembly through interconnection therewith by the restraining assembly.

As is appreciated by those individuals suffering from a spinal cord injury, various portions of the individual's torso may be more significantly affected by the location of the primary injury along the spinal cord. By way of example only, those individuals suffering from a lower spinal cord injury may have more extended use of the waist area, abdomen, chest, shoulders, arms, etc. than those individuals suffering from an injury located along the upper regions of the spinal cord. Accordingly, the different structural modification and operational features of the different harness structures are at least partially intended to engage different portions of the user's body such as, but not limited to, the waist, chest, shoulders, arms, etc. Therefore, different embodiments of the harness assembly, defined by the various structural modifications of the different harness structures are intended to engage, be connected to or mounted on different portions of the user's body which best facilitate the orientation and posture of the individual while performing an exercise or sporting activity. Concurrently, the individual will be safely secured to the anchoring assembly, rather than the wheelchair or other support structure, thereby being able to perform adequate and intended movement of appropriate body portions used in the performance of the exercise or physical activity.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
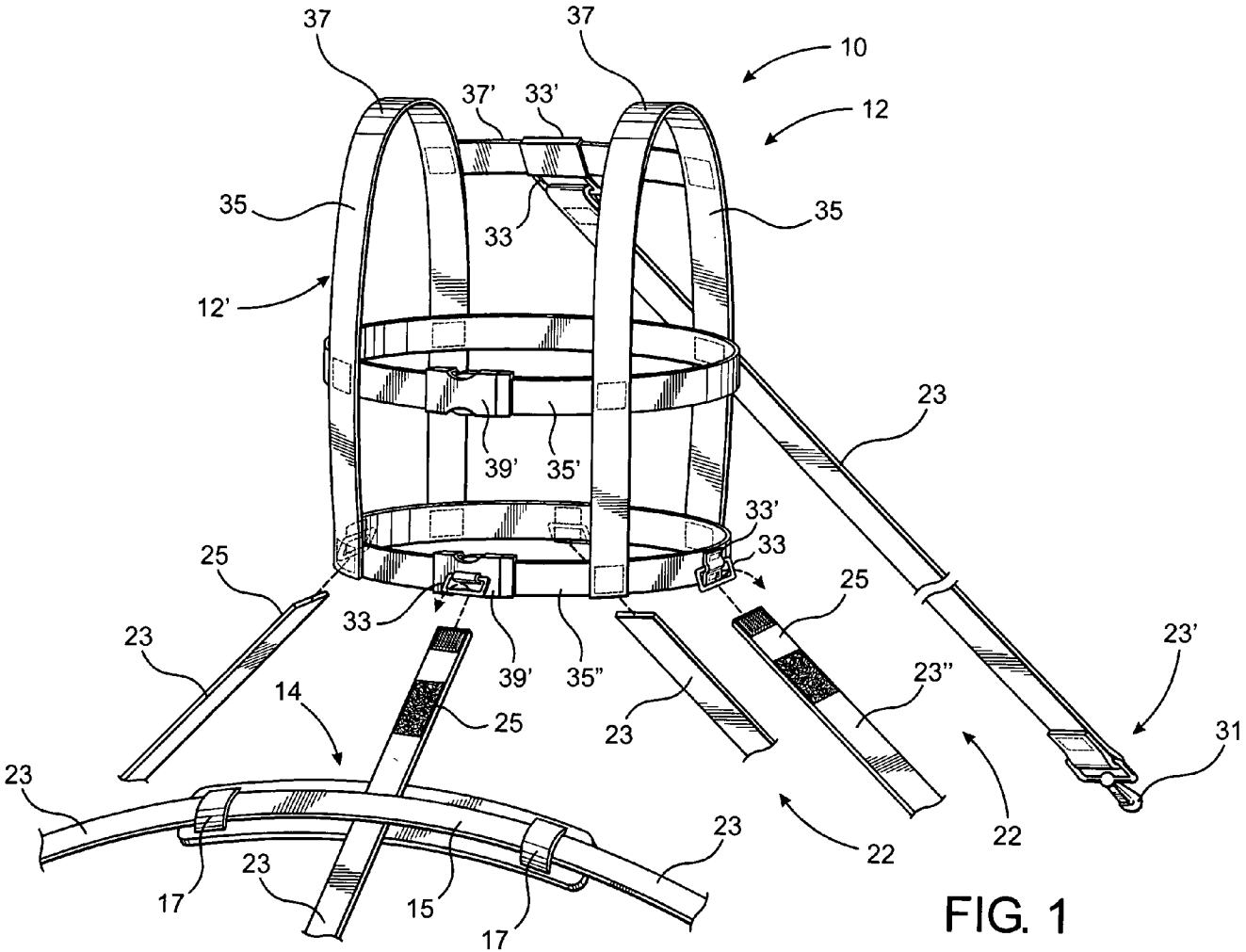
FIG. 1 is a perspective view of at least a portion of one preferred embodiment of the stabilization assembly of the present invention.

As shown in the accompanying drawings, the present invention is directed to an assembly for stabilizing an individual while exercising or performing any of a variety of different sports or other physical activities while in a seated position. The seated positioning of the exercising individual may be based on a need of the individual to use a wheelchair or any of a variety of other support structures which are intended to support the individual in a primarily seated orientation. Accordingly, as used herein the term "support structure" may or may not be mobile, at least in terms of providing the same mobility of a conventional wheelchair. Further, the stabilizing assembly 10 of the present invention may be used with any of a variety of conventionally structured and operable wheelchairs and/or other support structures, which are capable of positioning a seated individual in direct access to any of one or more exercise assemblies or which allows the individual to properly use any of a variety of different sporting equipment. It is also emphasized that the stabilizing assembly 10 of the present invention may be used with any of a variety of conventional or customized exercise and/or sporting apparatus, assemblies, etc. such as of the type utilized in a gym, therapeutic center, home environment, or other appropriate area of competition and use. Accordingly, for purposes of clarity particular exercise assemblies, sporting equipment etc. are not shown.

Moreover, the structural and operative features of the stabilizing assembly 10 serve to overcome many of the disadvantages and deficiencies of known or conventional devices by allowing an individual to utilize exercise and/or sporting equipment which is not specifically modified for use by seated individuals. However, the stabilizing assembly 10 is also adapted to be used with exercise equipment which is modified or customized for use by individuals requiring the use of a wheelchair or other support structures for supporting an individual in a substantially seated or other appropriate position. Accordingly, the stabilizing assembly 10 of the present invention may be utilized with any of a variety of conventional wheelchairs or other support structures without requiring modification of either the support structures or stabilizing assembly 10.

More specifically, the stabilizing assembly 10 comprises a harness assembly including at least one but more practically a plurality of harness structures. As shown throughout the accompanying Figures, the plurality of harness structures of the harness assembly 12 may comprise a vest-like harness structure 12', a lap structure generally indicated as 14, an annular member generally indicated as 16 preferably, but not necessarily, in the form of one or more belts disposed in surrounding relation to the waist or hips and/or the chest area and an auxiliary member generally indicated as 18. The specific description of these individual harness structures is not intended to be limiting as to the number of different harness structures which define the aforementioned harness assembly 12 of the stabilizing assembly 10. To the contrary, the detailed description provided hereinafter of the harness assembly 12 and the harness structures 12' 14, 16, 18, etc. is representative only of additional harness structures which may be utilized. The number, configuration, dimension, structure, etc is at least partially dependent on the different exercises being performed, the comfort, preference or physical condition of the individual, as well as the arrangement, disposition and/or structural configuration of the exercise apparatus used by an individual.

Figure 2:
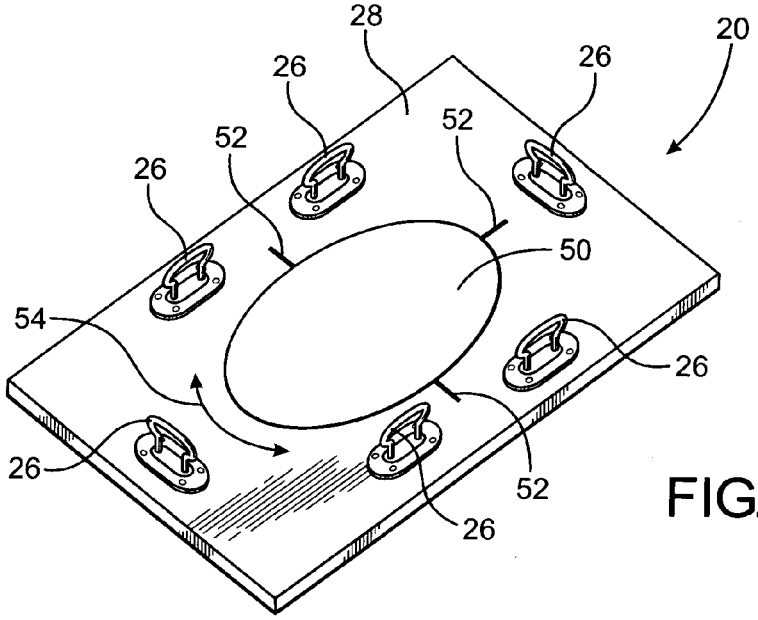
FIG. 2 is a perspective view of an anchor assembly of one preferred embodiment of the assembly of the present invention which is operatively associated with the embodiment of FIG. 1.

In addition, the stabilizing assembly 10 of the present invention further comprises an anchor assembly generally indicated as 20 in FIG. 2 and a restraint assembly generally indicated as 22, throughout the various Figures. In use, the restraint assembly 22 comprises a plurality of restraining members 23 being removably and/or adjustably attached to one or more of the harness structures 12', 12", 12'", 14, 16, 18, etc, being utilized and being removably connected to the anchor assembly 20. Removable connection of the plurality of restraining members 23 to the anchor assembly 20 is accomplished by virtue of a plurality of anchor members 26 located in spaced relation to one another about a support platform 28. The support platform 28 defines at least a portion of the anchor assembly 20, and as described in greater detail hereinafter, is intended to be disposed in underlying, supporting relation to a participating individual and the wheelchair or other support structure in which the individual is seated or otherwise supported. As represented in detail in FIG. 2A at least one embodiment of the anchor members 26 comprises an upper exposed portion 26' to which a connector 31 of the restraining member 23 may be removably attached. A lower or base portion 26" may be connected to the support platform 28.

Cooperative structuring and disposition of the anchor assembly 20 and the restraint assembly 22 facilitates restraint and stabilization of the corresponding portion of the individual's body to which one or more of the plurality of harness structures 12', 14, 16, 18, etc. are attached. Therefore, in at least one preferred embodiment of the present invention at least one or more parts of the exercising individual's body may be substantially maintained in a preferred operative position while an exercise or sports activity is being performed. However, it is emphasized that the one or more predetermined parts of the individual's body affected by the performance of a given exercise or sports activity may or may not be displaced a true "seated position" while still being properly and safely maintained in a "supported position" relative to a wheelchair or other support structure used by the individual.

Safely accomplishing such stabilization of each of the various portions of an individual's body involves the selective disposition of the plurality of restraining members 23 into a predetermined interconnected position between the one or more harness structures 12', 14, 16, 18, etc. secured to the individual and the anchor assembly 20. Therefore, the spaced apart array of the anchor members 26 on the support platform allow the user to interconnect each of the plurality of restraining members 23 being utilized to an appropriately positioned one of the anchor members 26 in order to properly "anchor" the harness structure 12', 14, 16, 18, etc. and therefore the individual to the anchor assembly 20 rather than to the support structure. The individual is thereby safely maintained in the aforementioned proper orientation and posture as well as the intended operative position.

As should be apparent, a different number of restraining members 23 may be utilized dependent on which of the plurality of harness structures are mounted on an individual's body. Further, the point of connection of each of the restraining members 23 both to the harness assembly 12 and to the support platform 28 will be dependent on the structure and configuration of the particular harness structure 12', 14, 16, 18, etc. being utilized as well as the exercise or sports activity being performed. Naturally, other factors may affect the number and placement of restraining members 23 needed to interconnect the harness assembly to the support platform 28 such as, but not limited to, the weight or size of the individual and/or any specific physical restrictions of the individual.

As will be described in greater detail hereinafter, in at least one of the preferred embodiments of the present invention, each of the plurality of restraining members 23 is formed from a strap, cord, cable or like structure which may be adjustable in length and which includes an outer or distal end 23' removably connected to an appropriate one of a plurality of anchor members 26. Such removable connection may be accomplished by a hook, snap hook or other substantially conventional connector generally indicated as 31. The opposite or proximal end 23" may be removably or fixedly connected to an appropriate one of the harness structures 12, 14, 16, 18, etc. When removably connected, a similar snap hook 31 or other connector, such as a hook and loop type connector 25 may be secured to the proximal end 23" and be attached to a ring connector 33 shown in detail throughout the various Figures. Each of a plurality of ring connectors 33 may be fixedly, but preferably movably and adjustably mounted by a surrounding flap 33' or by a variety of other means. However any means, including surrounding flap 33', used to interconnect the ring connectors 33 to a corresponding harness structure is preferably structured to allow selective and adjustable positioning of the connector(s) 33 along a length of the harness structure or harness segment to which it is attached. This in turn will allow disposition of the interconnected restraining members 23 at various appropriate positions on a particular harness assembly 12.

Figures 1A, 1B, 1C:
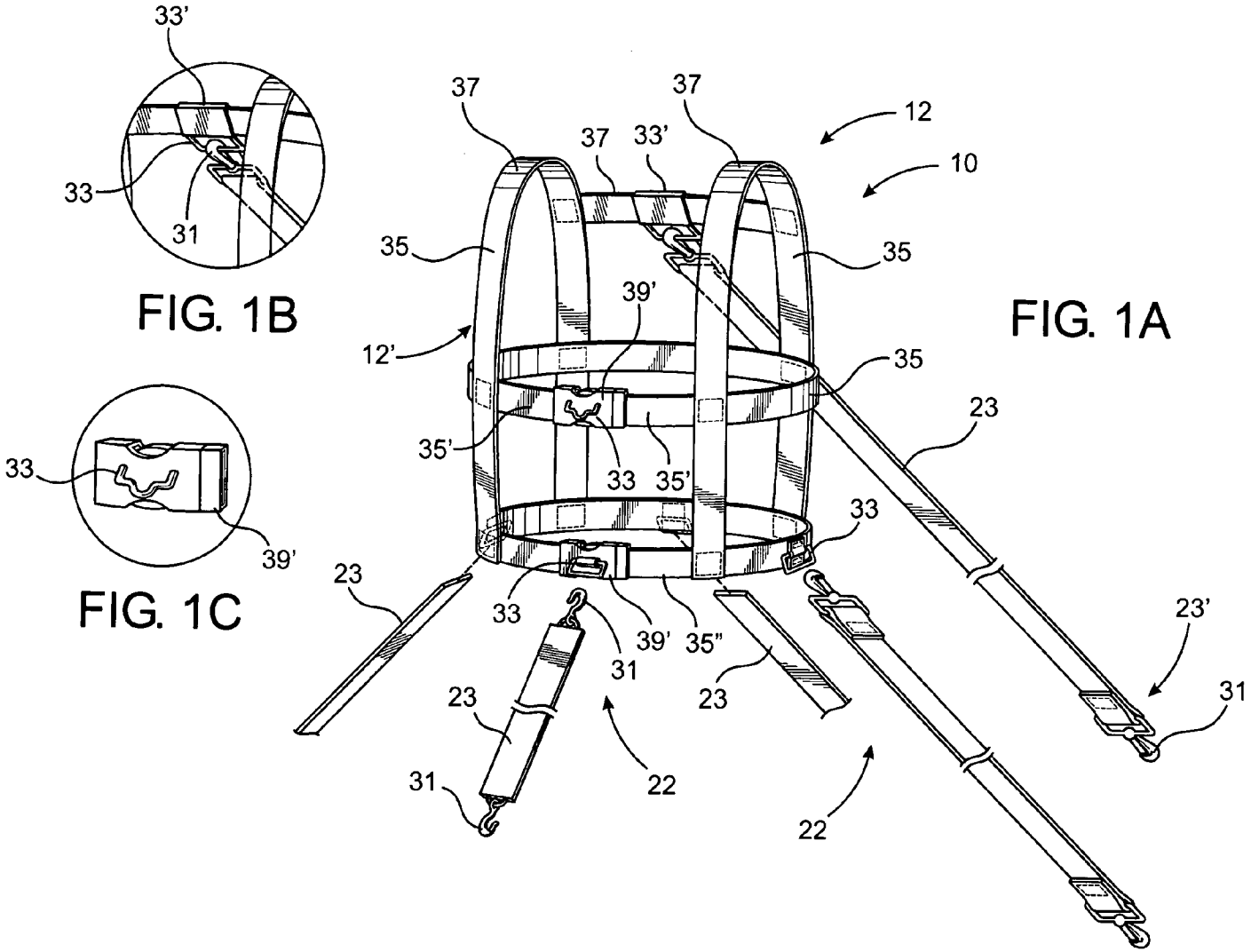
FIG. 1A is a perspective view representing certain structural modifications of the preferred embodiment of FIG. 1 primarily relating to the interconnecting of one or more restraining members to the harness structure thereof.
FIG. 1B is a detailed perspective view of structural portions of the embodiment of FIG. 1 primarily relating to the interconnection of one or more restraining members to specific portions of the harness assembly of the embodiment of FIGS. 1 and 1A.
FIG. 1C is a detailed perspective view of structural features also relating to the interconnection of one or more restraining members to the harness structure represented in FIGS. 1 and 1A.

For purposes of clarity, additional figures, including FIGS. 1A, 1B, 1C, 4A and 10A are included herein. These additional figures represent structural modifications of the preferred embodiments of the various harness structures and more specifically to the structure which serves to removably connect the restraining members 23 to the various embodiments of the harness structure, 12', 12", 12'", 14, 16, 18, etc. More specifically, as represented in FIG. 1A one or more of the restraining members 23 are interconnected to ring connectors 33 which in turn are mounted on movable and/or adjustable surrounding flaps 33' and/or on closure or attachment buckles 39' as described in greater detail hereinafter. Also, noted in FIG. 1B the cross brace member 37', also to be described in greater detail hereinafter, may include a mounting flap 33' which is preferably fixed, as versus adjustably attached, to the cross brace 37' or other wise fixedly interconnected to and between the shoulder straps 37. However, in certain structural modifications of the embodiments of FIGS. 1, 1A and 1B the mounting flap may be movably and/or adjustably mounted on or connected to the cross brace 37' such that it may be selectively positioned along the length thereof.

Figure 3:
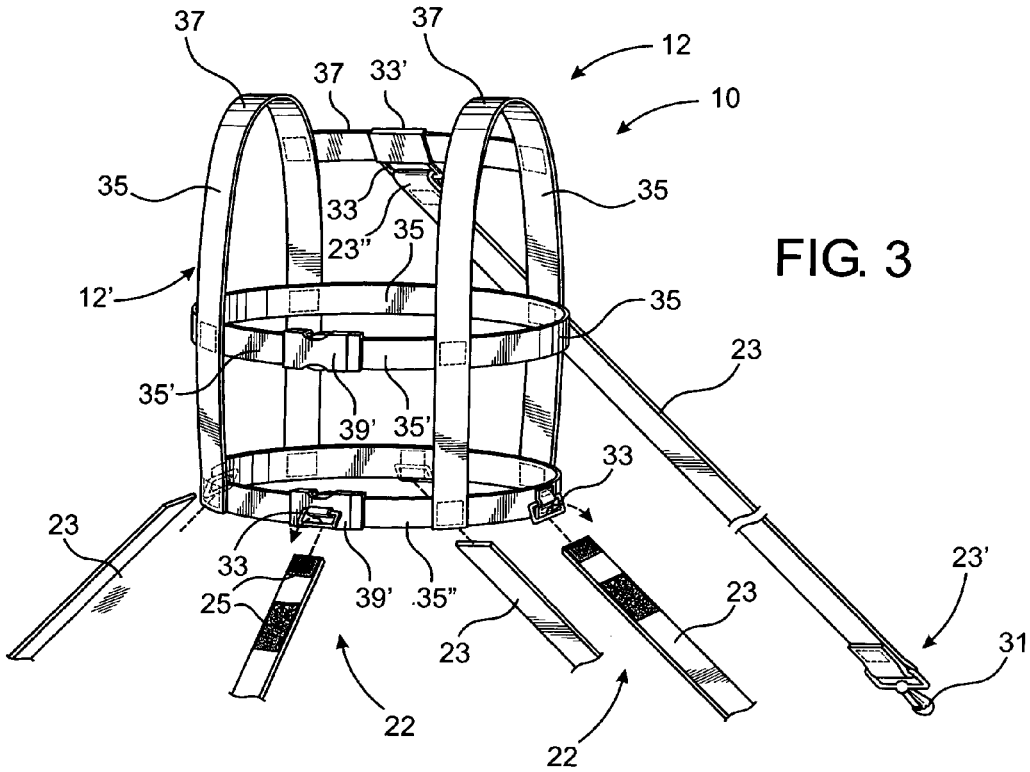
FIG. 3 is a perspective view of one of the harness structures associated with the embodiment of FIG. 1.

In addition one or all of the restraining members 23 may be connected to the ring type connectors 33 at selectively positionable points along the various harness segments 35, 35', 35", utilizing the aforementioned hook or snap hook 31 type of connector attached to both the opposite ends of the restraining members 23. As such, the hook or snap hook connectors 31 may be utilized to removably connect the corresponding end of the restraining members 23 to the various harness structures as well as to the anchor or anchor structures 26 associated with the support platform 28 or other embodiments of the anchor assembly 20. With primary reference to the embodiment of FIGS. 1 and 3, the vest-like structure of the harness assembly 12, including harness structure 12' includes at least one or a plurality of harness segments 35 preferably, but not necessarily, in the form of straps or like elongated members. As represented, the harness assembly 12 is structured and configured to define a "vest-like" structure 12' including the plurality of harness segments 35 integrally, fixedly or even adjustably secured to one another so as to substantially surround and embrace the front, back, side and waist portions of the middle and upper torso of an individual. In addition, the vest-like harness structure 12' also includes two spaced apart shoulder straps 37 also defined by appropriately disposed and structured harness segments 35. The shoulder straps 37 overlie the shoulders of the individual while the frontal portion overlies the chest area and waist portion of a user, as at 35' and 35" respectively. Similarly, the sides and rear of the harness structure 12' include a plurality of spaced apart integral, fixedly or adjustably interconnected harness segments 35 appropriately positioned to provide stabilization to the portion of the individual's body to which it is connected. As represented in FIG. 3, the plurality of restraining members 23 may be attached at any of a plurality of different locations by the preferably adjustably mounted connectors 33. In addition to the above, hook and loop type fasteners 25 or other detachable connectors as well as buckles 39' may be appropriately disposed to facilitate mounting and removal of the various harness structures 12', 14, 16, 18, and or harness segments 35, 35' 35" from the appropriate or corresponding portion of the individual's body.

As also represented in FIG. 1, the harness structure 12' comprises a lap restraining harness structure 14 structured and operatively disposed to overlie the lap or upper thighs of an individual. More specifically, the lap harness structure 14 comprises a substantially elongated body portion 15 having fixed or integrally structured loops 17 dimensioned and configured to allow passage of one or more restraining members 23 there through. The width or transverse dimension of the lap harness structure 14 is sufficient to provide proper resistance to the thighs of an individual thereby at least partially restricting movement thereof and maintaining the legs of the individual in an appropriate operative position depending on the exercise being performed. As also represented, the lap harness structure 14 may be connected to an additional one of the restraining members 23 connected to the vest harness structure 12 or be positioned independent thereof. It is recognized that certain individuals suffer from injuries that would make positioning of the lap harness structure 14 uncomfortable or impractical. Accordingly the other harness structures, such as those represented in FIGS. 1, 3, 5 and 7 through 10 may be used as described in detail herein.

Figure 4:
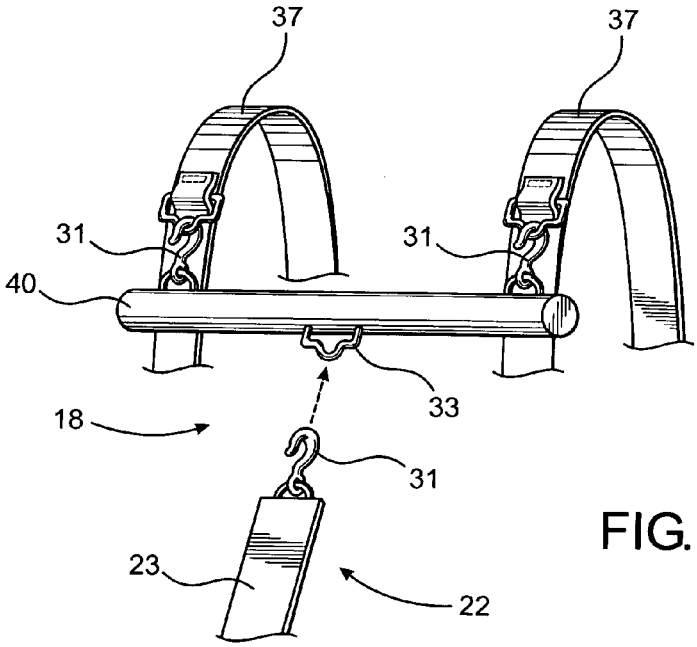
FIG. 4 is a detailed perspective view in partial cutaway of yet another preferred embodiment of the present invention comprising a different harness structure than that represented in FIGS. 1 through 3.

With primary reference to FIG. 4, one of the plurality of harness structures 18 comprises an elongated substantially rigid material shaft or bar 40 connected to each of the shoulder straps 37 and removably attached by appropriate connectors 31 thereto. The bar 40 therefore extends outwardly from a frontal portion of the vest like harness structure 12' and may be secured to one or more of the plurality of restraining members 23 by an appropriate connector 31 as described. The use of the bar 40 also is disposed and structured to enhance the posture or orientation of the individual, especially the upper torso portion, when performing certain exercises or physical activities and concurrently using the bar 40.

Figure 4A:
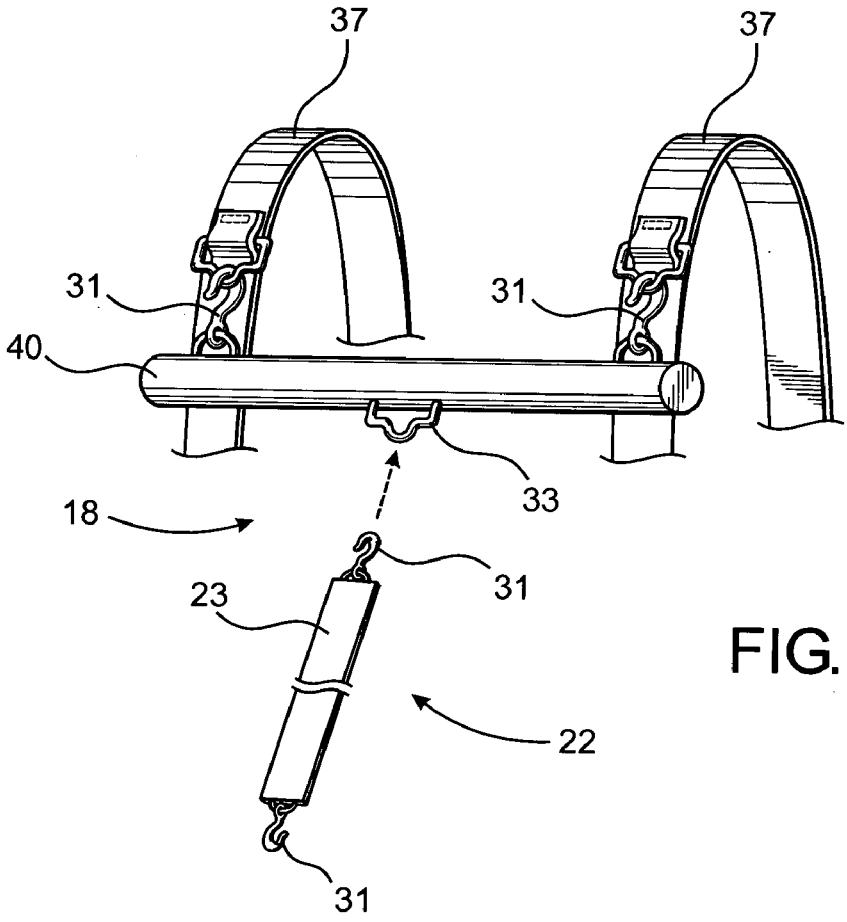
FIG. 4A is a perspective view of the embodiment of FIG. 4 representing in further detail the interconnecting structure of one or more of the restraining members to the harness structure of FIG. 4.
Figure 5:
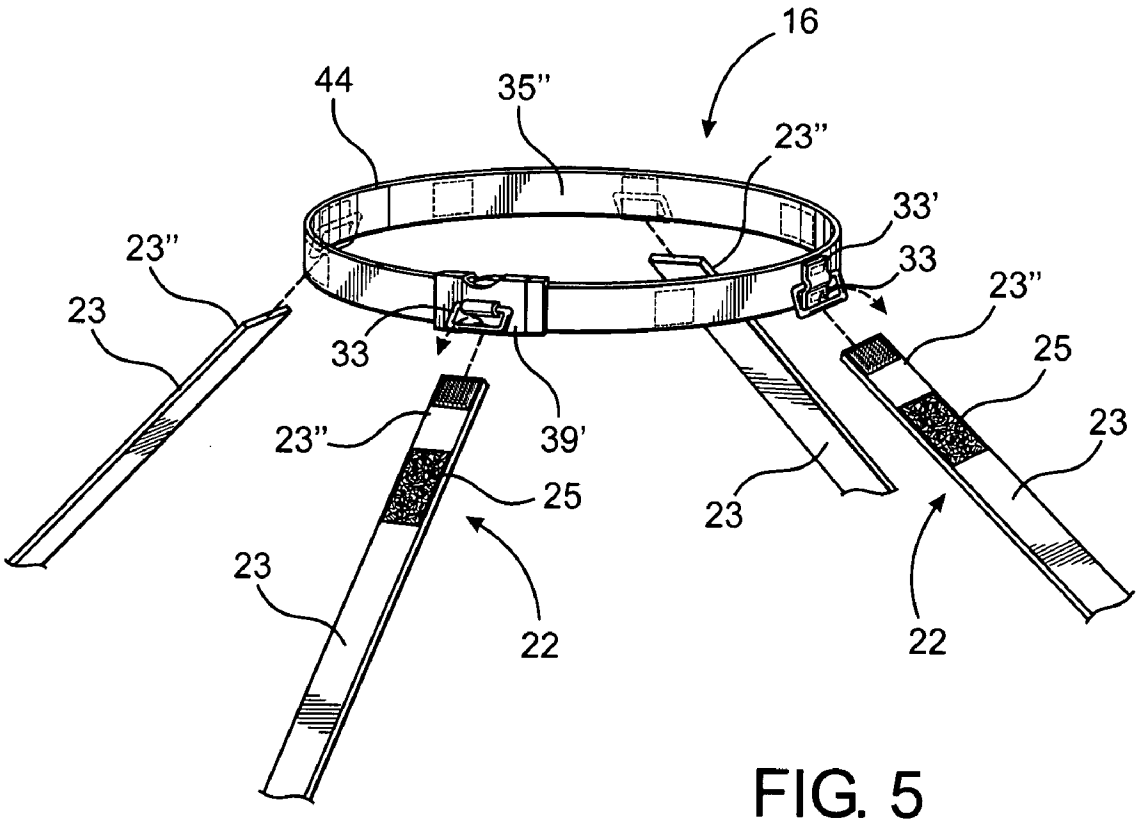
FIG. 5 is yet another preferred embodiment of the harness structure of the harness assembly of the present invention.

At least one additional preferred embodiment of the stabilizing assembly 10 of the present invention is represented in FIG. 5 and comprises an additional harness structure 16. The harness structure 16 comprises a substantially round or annular belt defined by at least one or possibly a plurality of interconnecting harness segments 35". It should be noted that the harness assembly 16 of FIG. 5 is similar to the harness structure 12' in FIG. 1 as well as the additional harness structures represented in FIGS. 7 through 10. To this extent, the harness structure 35" defines a waist belt which is dimensioned and configured to be removably disposed in surrounding relation generally about the waist of individual wearing the harness structure 16. As with other preferred embodiments described herein, the free ends or other appropriate portions of the harness segment, waist belt 35" may be removably connected to one another by a buckle or like attachment or connecting structure 39'. In addition, a plurality of restraint members 23 may be attached at various points along the length of the waist belt 35", wherein the corresponding ends 23" of each of the restraint members 23 are removably connected to ring like connectors 33. As also described herein, the ring like connectors 33 are movably and adjustably positioned along the length of the waist belt harness segment 35" by virtue of connecting flaps 33' being structured to be selectively disposed at various points along the length of the waist belt harness structure 35". In addition, the corresponding ends 23" of each of the restraint members 23 may have various type of connectors such as hook and loop type connectors 25 serving to facilitate the removable connection of the corresponding ends 23" to the ring like connectors 33. In the alternative, snap hook type connectors 31, as represented in FIGS. 1A, 4A and 10A may be substituted for the hook and loop type connectors 25.

In use, the harness structure 16 is disposed in surrounding relation to the waist of an individual during the performance of exercise, sporting or physical activities. As such, the harness structure 16 provides additional freedom of movement, particularly of the upper torso portion of the individual. As such, the waist belt harness segment 35" is absent the connection or attachment of shoulder straps 37 thereto as represented in the embodiments of FIGS. 1, 9, 10 and 10A. Also, due to the fact that shoulder straps are not utilized, there is also no need for a chest belt harness segment 35' and the embodiment of FIGS. 10 and 10A.

Figure 2A:
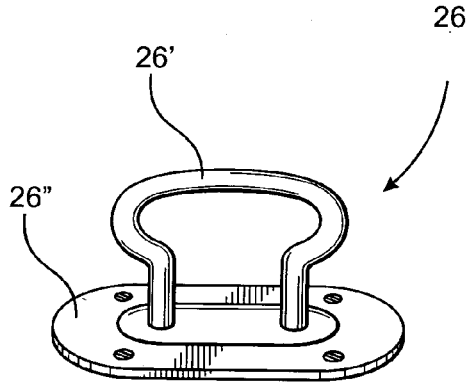
FIG. 2A is a perspective detailed view of a component of the anchoring assembly of the embodiment of FIG. 2.
Figure 6:
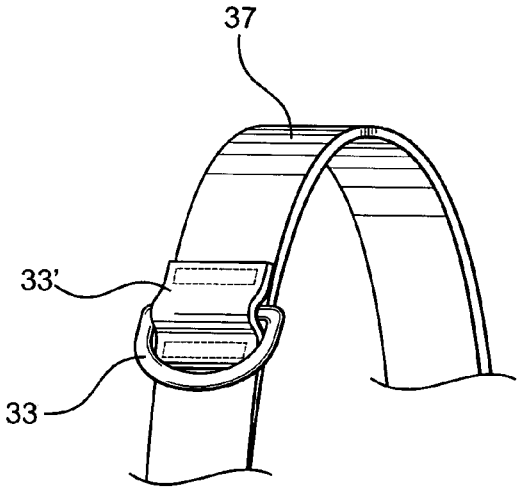
FIG. 6 is a detailed view in partial cutaway of one of a plurality of loop-type connectors secured to each of the harness structures.

Yet another preferred embodiment of the stabilizing assembly 10 of the present invention comprises the anchoring assembly 20, represented in FIGS. 2 and 2A and including a support segment 50 mounted on or defining at least a portion of the support platform 28 and being structured to be movable relative thereto. In this preferred embodiment, the wheelchair or other support structure on which the participating individual is seated may be mounted directly on the exposed surface of the support segment 50. Moreover, when the support segment 50 is unlocked or movably connected relative to the support platform 28, the rotational or angular orientation of the individual while seated on the wheelchair or support structure can be changed so as to reach or access any of a plurality of different exercise devices associated with the overall exercise assembly. This eliminates the necessity of extensive movement or repositioning of the individual and the wheelchair, relative to various portions of a somewhat conventional exercise assembly in order to perform a plurality of different exercises as is common with modern day exercise equipment.

In order to facilitate the intended stability of the individual, regardless of the orientation chosen, a plurality of locking structures as at 52 may be disposed in interconnecting relation between the support platform 28 and the rotational support segment 50. Each of the one or more locking structures 52 is disposed and structured to facilitate the locked or fixed positioning of the support segment 50 in any of a plurality of different intended orientations relative to the support platform 28. Moreover, the rotation or other appropriate movement 54 of the support segment relative to the support platform 28 is schematically indicated by directional arrow 54. Such relative movement of the support segment may be accomplished by a bearing and bearing race assembly disposed in interconnecting relation between cooperatively structured and correspondingly disposed portions of the support platform 28 and the support segment 50. As emphasized above, the anchor assembly 20 may be defined by a floor, ground or other support surface on which the wheelchair or other support structure may be disposed. In this case the support platform 28 would be eliminated and the connectors 26 would be connected directly to the floor, ground or other supporting surface. Also, when the support platform is utilized it may or may not be secured to an underlying support surface or structure.

As set forth above, the support platform 28 of the anchor assembly 20 is disposed in underlying, supporting relation to a wheelchair or other support structure on which the individual is seated. Therefore, the weight of the wheelchair or other support structure as well as that of the individual serves to maintain the anchor assembly 20 and more specifically the support platform 28 in an intended position. While disposed in this intended, anchored position, the support platform 28 will be fixed relative to the floor or other surface on which it is mounted. In contrast, the support segment 50 may be allowed to at least minimally rotate, as indicated by directional arrow 54, in order to selectively change the orientation of the individual while in the wheelchair in order to use any of a plurality of different exercise apparatus associated with an overall combined exercise assembly. Also, another preferred embodiment of the present invention may include the anchor assembly 20 comprising the support platform 28, without the inclusion of the rotational support segment 50.

Therefore, the stabilizing assembly 10 of the present invention, including its various structural and operative components described above, appears to overcome many of the deficiencies and disadvantages associated with known assemblies attempting to stabilize an individual while performing exercise in a seated orientation. In doing so, the stabilizing assembly 10 is removably and adjustably secured directly to the individual or more specifically, the various portions of the individual's body most predominantly associated with the exercise being performed. In addition, the various features of the stabilizing assembly 10 allow it to be used with conventional exercising equipment rather than requiring customizing of either the exercise equipment, the wheelchair or other support structure on which the individual is seated or other apparatus at least partially associated with the exercise of an individual while in a seated orientation.

Figure 7:
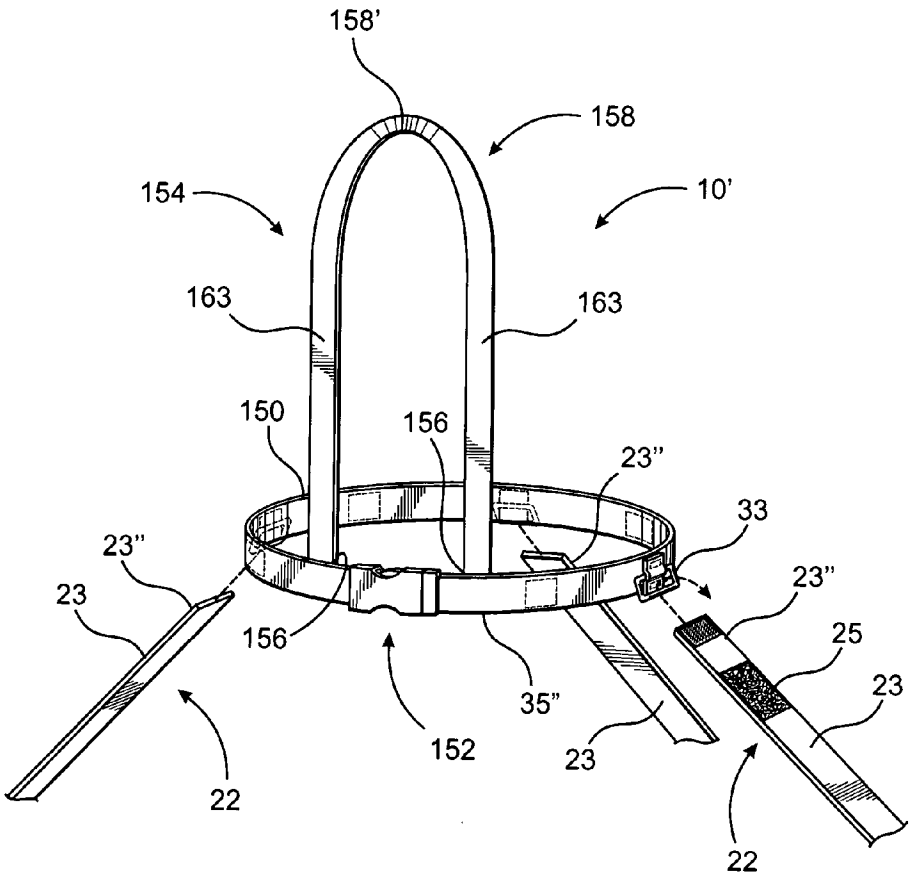
FIG. 7 is a perspective view disclosing at one preferred additional embodiment of the present invention.
Figure 8:
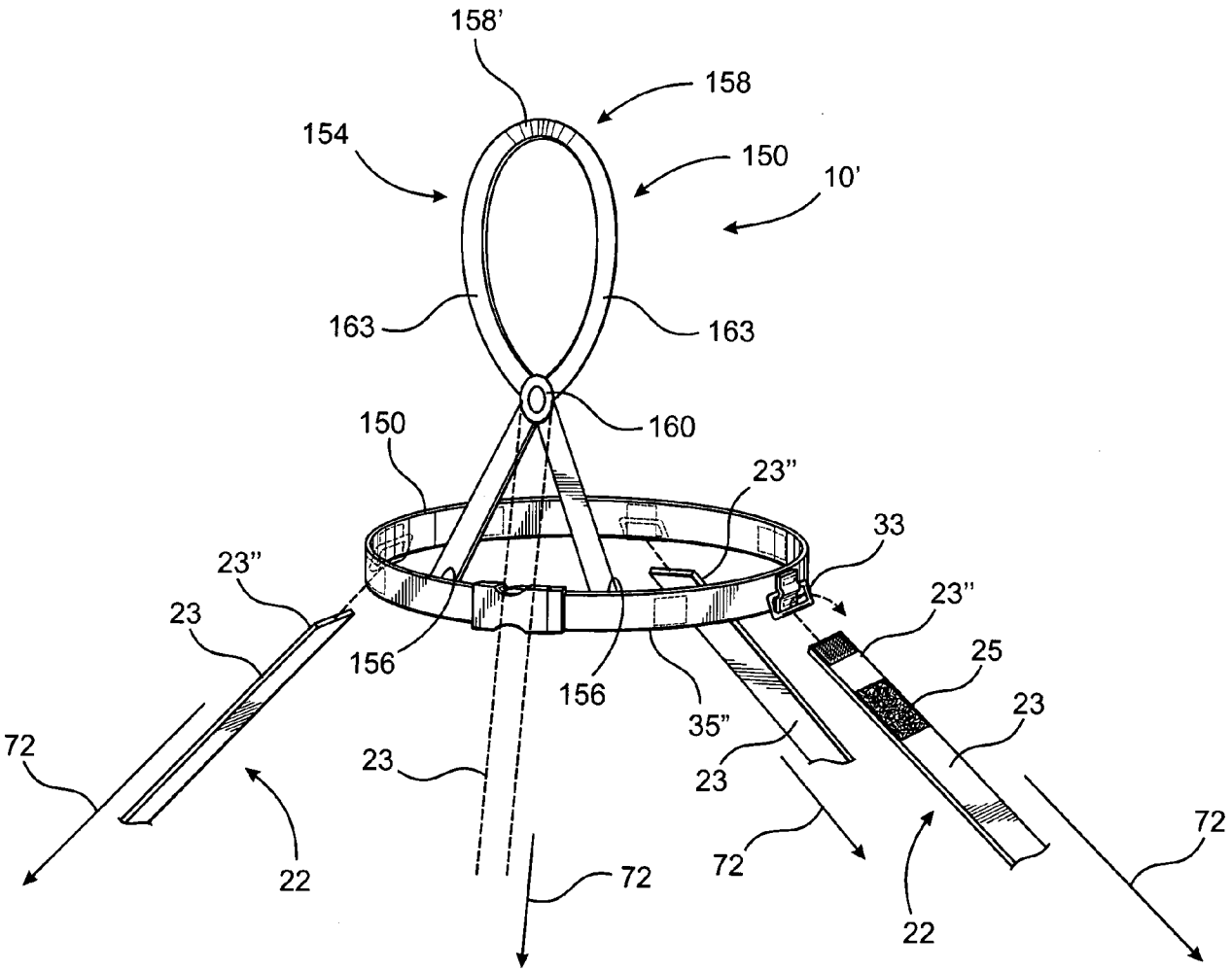
FIG. 8 is a perspective view of the embodiment of FIG. 7 wherein an attachment assembly is connected to one of a plurality of harness structures so as to maintain it in a closed operative orientation.

With reference to the additional embodiments of FIGS. 7 and 8, comprise a structural modification of the stabilizing assembly 10 as represented in FIGS. 1 and 3. More specifically, in the preferred embodiments of FIGS. 7 and 8, the stabilizing assembly 10' comprises first harness structure 150 having a somewhat elongated configuration and defined by one or more fixedly or integrally connected harness segments 35 similar to the harness segments as described in the embodiment of FIGS. 1 through 6. The one harness structure 150 may be more specifically defined as a "waist belt". As such, it is dimensioned and configured to fit about the waist of an individual so as to firmly but removably secure the overall harness assembly, represented in FIGS. 7 and 8 to the individual. Moreover, the securement or attachment of the one harness structure or waist belt 150 may be further facilitated through the provision of a buckle 39' or like connecting structure generally indicated as 152. Naturally, other means of attachment of the one harness structure or waist belt 150 may be utilized other than the buckle 152.

The additional preferred embodiments of the stabilizing assembly 10' also include the aforementioned restraining assembly 22 comprising a plurality of restraining members 23. Similarly, each of the restraining members 23 are removably connected at corresponding ends to the one harness structure or waist belt 150 by means of connecting loops or like connectors 33 adjustably positioned along the length of the harness structure 35 or waist belt 150 as also described above in detail. The interconnection of the corresponding ends 23" of the plurality of restraining members 23 may be accomplished by a hook and loop type fastener 25 connected to the corresponding ends 23" or by a variety of other connecting structures intended to removably connect the ends 23" to the one harness structure or waist belt 150. Also, as with the embodiments of FIGS. 1 through 6, the opposite ends of each of the restraining members 23 are removably connected to the anchor assembly 20 including, but not limited to, the support platform 28 by means of structures 26 as represented in FIGS. 2 and 2A.

Accordingly, the removable attachment of the plurality of restraining members 23 to the one harness structure or waist belt 150 serves to stabilize the position of the one harness structure 150, as well as the portion of the body, such as the waist portion, of the individual to which the harness structure 150 is attached.

Yet another structural feature as clearly represented in FIGS. 7 and 8 is the provision of a second harness structure 154 associated with the embodiment of the stabilizing assembly 10'. The second harness structure 154 comprises an elongated configuration having opposite ends as at 156 fixedly or removably connected to the first harness structure or waist belt 150 and extending outwardly or more specifically upwardly therefrom. Accordingly, when it is mounted on the individual performing exercises, the second harness structure 154 overlies the frontal portion of the individual and includes an open-loop type of structure generally indicated as 158 being disposed in at least partially surrounding relation to the back of the neck of the exercising individual. Further, the open-loop structure or configuration 158 includes at least a portion or segment of the length thereof, as at 158', disposed in confronting engagement with the back of the neck of the exercising individual. Therefore, when the stabilizing assembly 10' is removably secured to an individual, in an intended fashion, segment 158' will be firmly but removably connected to the individual in a manner which allows at least some freedom of movement of the upper torso portion of the individual relative to the first harness structure or waist belt 150.

Such freedom of movement facilitates the individual on which the stabilizing assembly 10' is mounted being able to perform a wider variety of exercises which may require an unfettered movement of the upper torso portion. At the same time, the individual is maintained in an overall stable orientation relative to wheelchair or support structure on which he/she is at least partially supported. While not specifically disclosed, the aforementioned freedom of movement allows the individual wearing the stabilizing assembly 10' to perform various punching, lifting, pulling, pushing motions or movements associated with corresponding exercising devices or assemblies thereby providing the individual with a more complete workout.

Additional structural and operative features of the embodiment of the stabilizing assembly 10' as represented in FIGS. 7 and 8 includes the provision of an attachment assembly generally indicated as 160. The attachment assembly 160 is connected to or mounted on the second harness structure 154 which may also be defined as a single shoulder strap extending over the shoulder area of the individual. The second harness structure or single shoulder strap 154 includes opposite 156 and the open loop segment 158' of the second harness structure 154. Further, the attachment assembly 160 is disposed and structured to removably interconnect correspondingly disposed segments 163 along the length of the second harness structure 154. Moreover, the attachment assembly 160 is thereby capable of releasably maintaining and/or positioning the second harness structure 154 into a closed operative orientation as represented in FIG. 8 or release the corresponding lengths or segments 163 so that they may assume an open operative orientation, as represented in FIG. 7. In either the open or closed operative orientations of FIGS. 7 and 8 respectively, the open-loop configuration 158 and in particular the segment 158' thereof is disposed in at least partially surrounding and/or confronting relation to the back of the neck of the individual.

However, when the second harness structure 154 is in the closed operative orientation of FIG. 8, the attachment assembly 160 removably interconnects the side segments 163. As such one of the restraining members 23 may be removably connected directly to the attachment assembly 160 as schematically represented in phantom lines in FIG. 8 and exert a restraining force 72 thereon. Accordingly, during the performance of certain predetermined exercises, a restraining force 72 may be exerted on the second harness structure 150 by its direct connection to the attachment assembly 160. In turn, the restraining force will be exerted on the one harness structure 35" defined by the waist belt 150 thereby having a tendency to safely maintain the body of the individual in its intended operative position.

Figure 9:
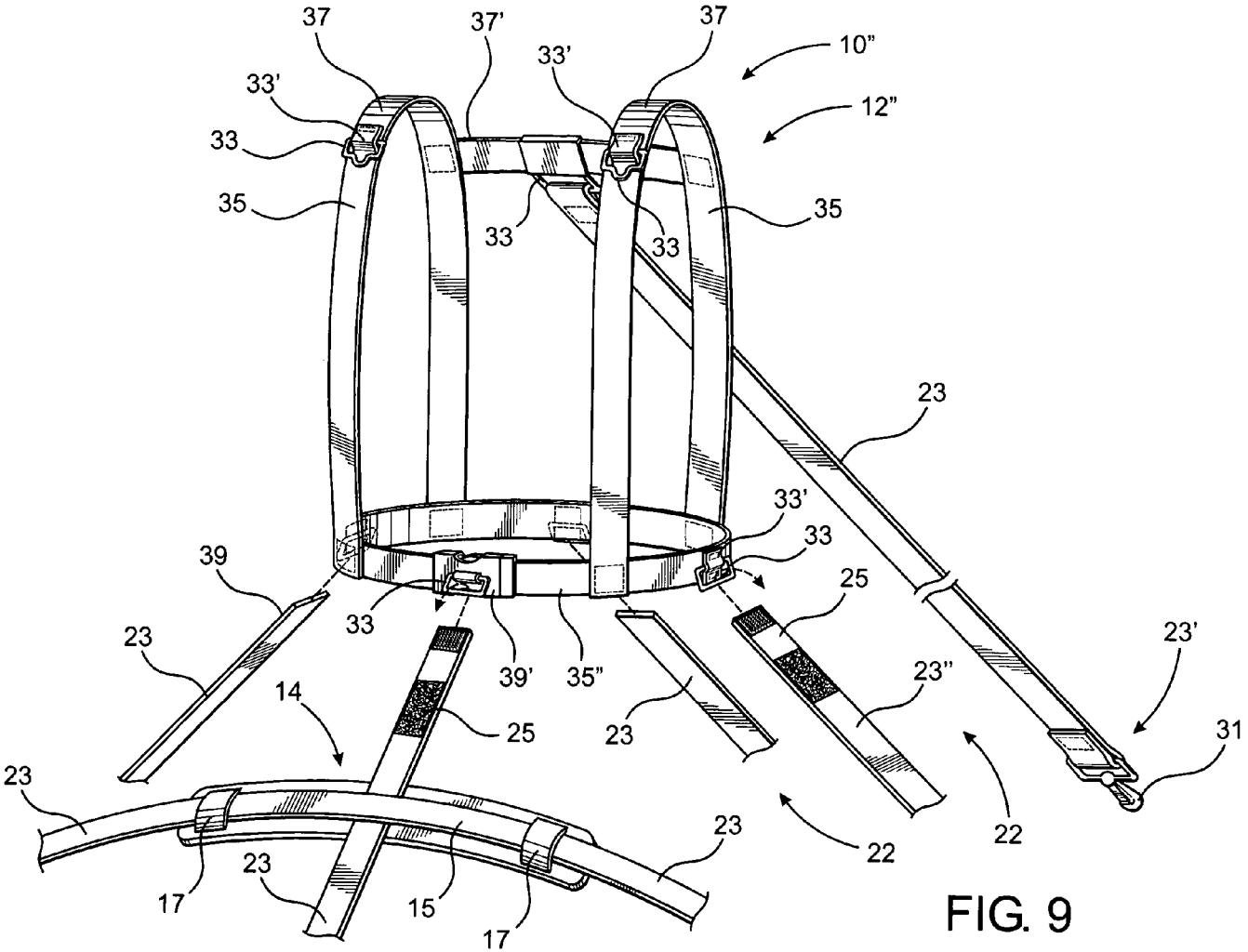
FIG. 9 is yet another preferred embodiment of the present invention representative of a harness structure structurally modified from the embodiments of FIGS. 1, 3, 7 and 8.
Figure 10:
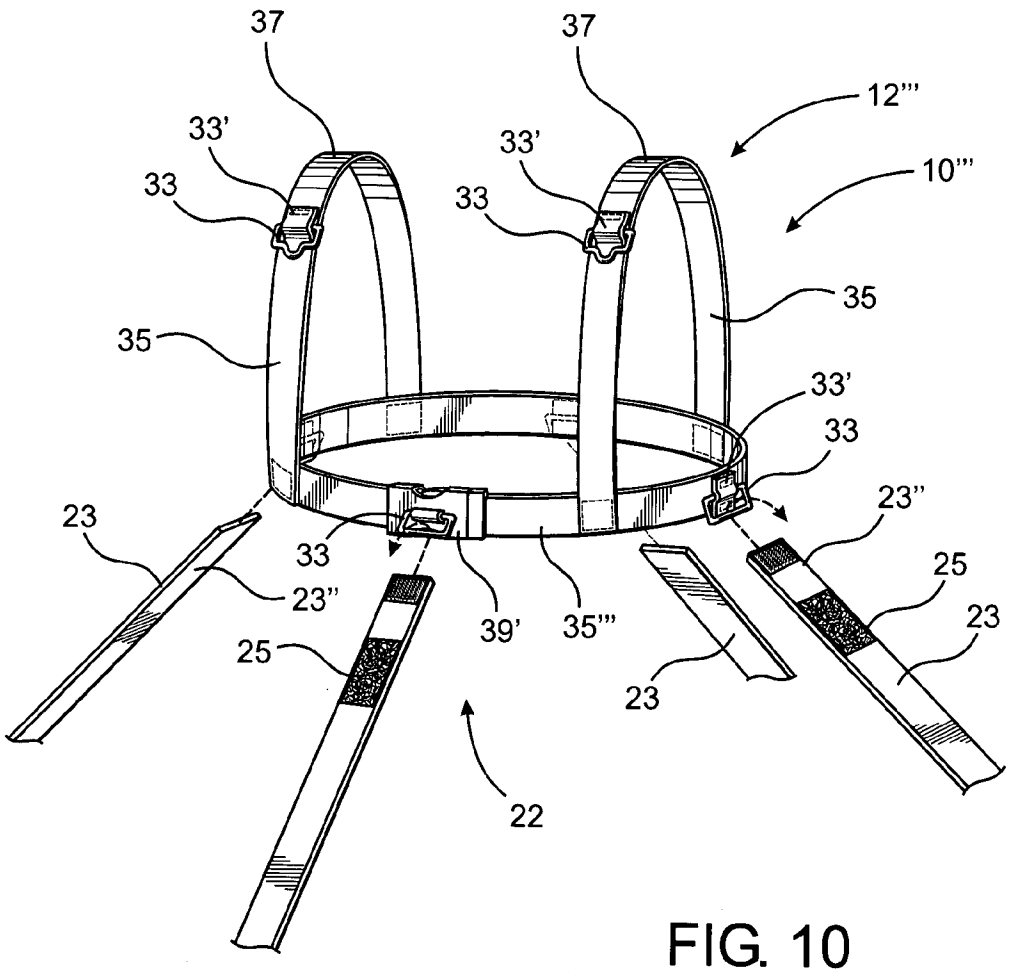
FIG. 10 is yet another preferred embodiment of a harness structure of the harness assembly which differs from the additional embodiments represented in FIGS. 1, 3, 5, and 7-9.
Figure 10A:
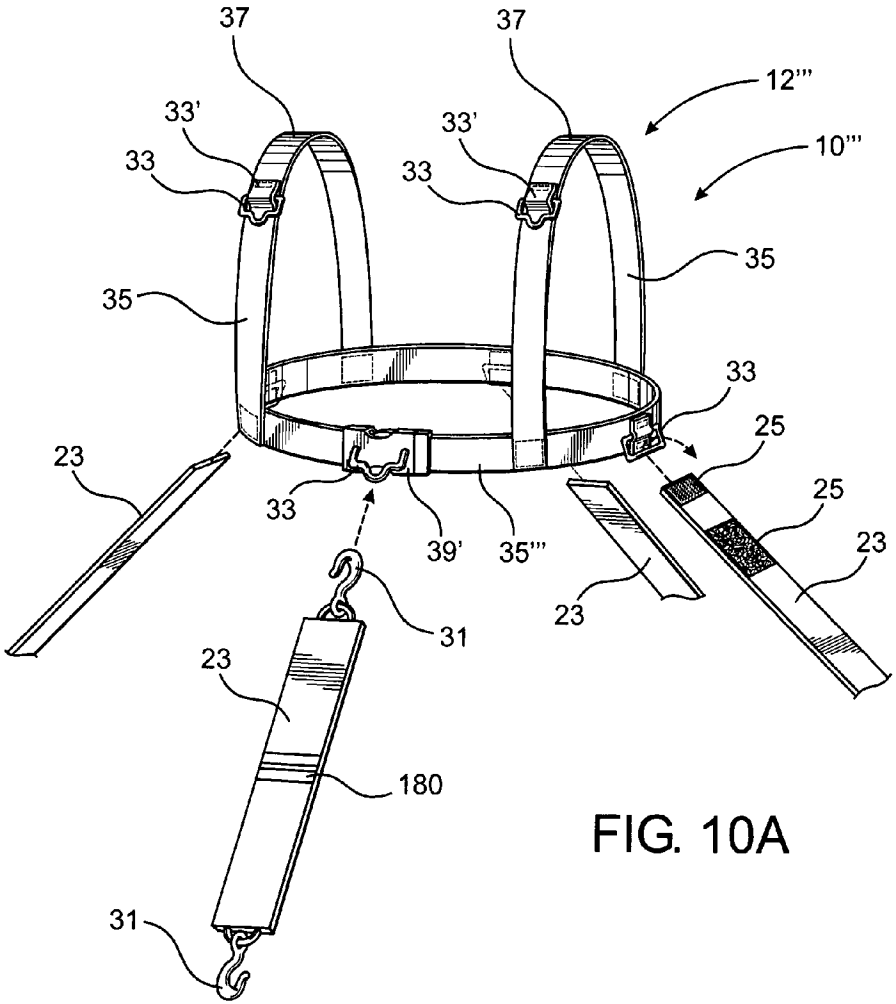
FIG. 10A is a perspective view of the embodiment of FIG. 10 wherein additional structural modifications are represented which are primarily directed to the interconnection of one or more restraining members to the represented harness structure of FIG. 10.

As represented in FIGS. 9 and 10, the stabilizing assembly is respectfully represented as 10" and 10'". These additional preferred embodiments are a modification of the preferred embodiments of FIG. 1, wherein such structural modifications are provided to facilitate comfort, stability and safety to an individual while performing various exercises or sporting activities. Further, the selection by an individual using the embodiments of FIGS. 1, 9, or 10 may dependent, at least in part, on the type location of injury, such as along the spinal column when such injury is the cause of the physical limitations of the individual.

With primary reference to FIG. 9, the stabilizing assembly 10" comprises a harness structure 12" which is similar in structure to the embodiment of FIG. 1 absent the harness segment 35' as disclosed therein. More specifically, in the preferred embodiment of FIG. 9, the harness assembly 12" includes harness segment 35" which is disposed, dimensioned and structured to fit generally about the waist, hip and/or adjacent lower torso portion of the individual. As such, a buckle 39' may be used to connect opposite free ends of the waist belt structure 35" and may be further structured to adjust the overall the continuous length of the harness segment or waist belt portion 35". Such adjustability is provided for purposes of conforming to individuals of various sizes, ages, different genders, etc.

Similar to the above described harness structures, this preferred embodiment includes a restraining assembly 22 comprising a plurality of restraining members 23 each connected by loop type connectors 33 to the waist belt portion or structure 35" so as to provide a restraining force thereto and thereby serve to anchor the individual to the anchor assembly 20, rather than the wheelchair or other support structure. As set forth above, the anchor assembly may be in the form of the support platform 28, floor, ground or other support surface to which the connectors 26 are secured. The embodiment of FIG. 9 also may be used with the lap structure 14, as described above, and may include the interconnection of the plurality of restraining members 23 at various portions along the shoulder straps 37, waist belt portion 35" and cross brace strap 37'. As represented, the cross brace strap 37 is interconnected between the should straps 37 and is disposed in overlying relation to an upper back or rear torso portion of the individual on which the harness structure 12" is mounted. As also set forth above, the various connectors 33 and the adjustable, interconnecting flaps 33' may be adjustably disposed at any appropriate position along the continuous length of the waist belt portion 35" in order to properly locate the interconnecting restraining members 23.

With primary reference to the additional preferred embodiment of FIG. 10, the stabilizing assembly 10''' comprises and is at least partially defined by a harness structure 12''' including an annular harness segment 35''' which is in the form of a "chest belt" as versus the waist belt harness segment 35" represented in the embodiments of FIGS. 1 though 9. Moreover, the chest belt harness segment 35''' is disposed in removably connected, at least partially surrounding relation to the chest and/or adjacent upper torso portion of an individual. In addition, the harness structure 12''' includes two should straps 37 having opposite ends connected to the frontal and rear portions of the chest belt 35'''. As such, the should straps 37 extend over the shoulders of the individual and are significantly shorter than the shoulder straps 37 as represented in FIG. 9. The reduction in length of the shoulder straps 37 is, of course, due to the fact, that the chest belt 35''' surrounds the chest or upper torso portion as versus the waist belt 35" represented in the embodiments of FIGS. 1 and 9. Accordingly, the purpose of the chest belt 35''' is to provide additional comfort to a physically challenged individual, wherein the utilization of the waist belt 35", disposed and structured to surround the waist area of the individual is believed to uncomfortable or not as effective based on an individual's injury and/or the exercise being performed. While not represented in FIG. 10, the shoulder straps 37 may be interconnected by the cross brace 37' as represented in FIGS. 1 and 9. Also the restraining assembly 22 may include the plurality of restraining members 23 disposed in interconnecting relation between the anchor assembly 20 and the chest belt 35'''. As with the previously noted embodiments, the ends 23" of the restraining members 23 may be interconnected to appropriately portion ones of the connectors 33, wherein the connectors 33 may be movably or adjustably positioned along the length of the chest belt 35'''. Such connectors 33 are also adjustably connected and selectively positionable along the length of the shoulder straps 37 as represented in both the additional preferred embodiments of FIGS. 9 and 10. Also, as with other embodiments, a similar connector 33 may be secured directly to the buckle 39' thereby further adding versatility in placement of the restraining members 23 so as to assure a safe and stabilizing interconnection between the harness structure 12''' worn by the individual and the anchoring assembly 20.

Accordingly, at least some of the distinguishing features of the preferred embodiments of the harness structure 12', 12" 12''', 16, respectively represented in FIGS. 1, 9, 10 and 5 are the inclusion of one or both of the waist belt 35" and a chest belt 35' respectively disposed in surrounding relation to the waist and chest area of an individual. More specifically, the shoulder straps 37 in the embodiment of FIG. 1 includes opposite ends connected to and terminating at front and rear portions of the waist belt, harness structure 35". Moreover, the chest belt 35' is connected intermediate the opposite ends of the shoulder straps 37 about front and rear portions thereof and in spaced relation to the waist belt 35".

In the embodiment of FIG. 9 only a single waist belt 35" is provided and is dimensioned and structured for surrounding relation to the waist area of an individual. In this embodiment the shoulder straps 37 have their opposite ends connected to and terminating at front and rear portions of the waist belt or harness structure 35'.

In the embodiment of FIG. 10, only a single chest belt 35''' is included. The chest belt harness segment 35''' is dimensioned and structured for surrounding relation to the chest area of the individual. Further, the shoulder straps 37 each have opposite ends connected to and terminating at the front and rear portions of the chest belt or harness structure 35".

In order to enhance the versatility of the stabilization assembly 10 and more specifically, each of the various preferred embodiments of the harness assembly, the harness segments associated therewith, may be removably connected to one another. By way of example, in the embodiment of FIG. 1, the chest belt 35' of FIG. 1 can be removed or detached from the shoulder straps 37 in order to form or define the preferred embodiment of FIG. 9, which is absent a chest belt. In addition, the formation of the preferred embodiment of FIG. 10 can be accomplished by a removal or detachment of the waist belt harness segment 35" from the embodiment of FIG. 1 and the lengths of the shoulder straps 37 can then be shortened in accord with the representation of FIGS. 10 and 10A. The result will be the harness structure 12''', which is absent the waist belt harness segment 35", utilized in the embodiments of FIGS. 1 and 9. Similarly, the embodiment of FIG. 5 may be formed by detaching the chest belt segment as well as the shoulder straps 37 from the waist belt harness segment 35'. As such, the additional preferred embodiment of the harness structure 16 can be "created", wherein this harness structure 16 only includes a harness segment 35" comprising a waist belt and is specifically absent the harness segments defining a chest belt and interconnecting shoulder straps.

Yet additional structural features of the preferred embodiment of the harness structures represented throughout the figures include the ability to adjust the length of each the harness segments. More specifically, as set forth above, the waist belt harness segment and the chest belt harness segment of each of the preferred embodiments utilizing these components may have their length adjusted through a modified or different structuring of the attachment or connecting buckle 39'. Naturally, other length adjusting connectors may be connected to or used directly in association with the waist and chest belt harness segments. In addition, the shoulder straps 37 may also have their lengths selectively adjusted. The adjustment of the lengths of the shoulder straps is specifically evident in a comparison of the embodiments of FIGS. 9 and 10. As represented, the length of the shoulder straps 37 in the embodiment of FIGS. 10 and 10A is significantly shorter than the length of the shoulder straps and the embodiment of FIG. 9. As set forth above in detail, the shoulder straps 37 in the embodiment of FIGS. 10 and 10A have the opposite ends thereof connected to and terminating at the chest belt which is disposed in surrounding relation to a chest area of the individual. In contrast, the embodiment of FIG. 9 has the length of the shoulder straps 37 extended in that their opposite ends are connected and terminate at the waist belt harness segment.

In addition each or at least some of the plurality of restraining members 23 may also have an interconnecting, length adjusting connector as schematically represented as 180 in FIG. 10. It is emphasized that while a single length adjustment structure 180 is represented on a single one of restraining members 23, the present invention contemplates all or at least a plurality of restraining members 23 including the length adjustment structure 180 appropriately mounted thereon or connected thereto.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly for stabilizing an individual seated on a support structure while exercising, said assembly comprising:

a harness assembly including at least one harness structure comprising a chest belt dimensioned and configured to be secured in substantially surrounding relation about the individual, said harness assembly further including a plurality of shoulder straps each having opposite ends connected to and terminating at front and rear portions of said chest belt, an anchor assembly disposed in underlying relation to the support structure, a restraint assembly comprising a plurality of restraining members, at least some of said plurality of restraining members are disposed in interconnecting relation to said chest belt and said anchor assembly, at least some others of said plurality of restraining members disposed in interconnecting relation between said plurality of shoulder straps and said anchor assembly, and said plurality of restraining members and said anchor assembly cooperatively disposed and structured to maintain said chest belt and said plurality of shoulder straps in an operative position during exercise.

2. An assembly as recited in claim 1 wherein said plurality of restraining members are movably and adjustably connected at any of a plurality of locations along a length of said chest belt.

3. An assembly as recited in claim 1 wherein said plurality of restraining members are movably connected to at least one of said chest belt and said anchor assembly.

4. An assembly as recited in claim 1 wherein said support assembly is sufficiently dimensioned and structured to support the support structure in an operative position thereon.

5. An assembly as recited in claim 1 wherein said restraining assembly is disposed and structured to interconnect said harness assembly to the anchor assembly independent of the support structure.

6. An assembly for stabilizing an individual seated on a support structure while exercising, said assembly comprising:

a harness assembly including a waist belt and a chest belt disposed in spaced apart relation to one another, said waist belt dimensioned and structured for removable, surrounding relation to the individual, said chest belt dimensioned and structured for removable, surrounding relation to the individual, an anchor assembly disposed in underlying relation to the support structure, a restraint assembly comprising a plurality of restraining members each including opposite ends connected to and terminating at front and rear portions of said waist belt, said chest belt connected to intermediate portions of said plurality of restraining members in spaced relation to said waist belt, and said plurality of restraining members and said anchor assembly cooperatively disposed and structured to maintain said waist and said chest belt in an operative position during exercise.

7. An assembly as recited in claim 6 wherein said plurality of said restraining members are disposed and structured to be concurrently connectable to both said waist belt and said chest belt.

8. An assembly as recited in claim 6 wherein corresponding ones of said plurality of said restraining members are moveably and adjustably connected along a length of said waist belt and a length of said chest belt.

9. An assembly as recited in claim 6 wherein said restraint assembly is disposed and structured to interconnect said harness assembly to the anchor assembly independent of the support structure.

* * * * *